US005108211A

United States Patent [19]

Rigoni

[11] Patent Number: 5,108,211

[45] Date of Patent: Apr. 28, 1992

[54] HAND HELD WRITING INSTRUMENT WITH BUILT IN STAMP

[75] Inventor: Herbert Rigoni, Fischbach, Fed. Rep. of Germany

[73] Assignee: Heri Gerate-Produktions-GmbH, Fischbach, Fed. Rep. of Germany

[21] Appl. No.: 612,984

[22] Filed: Nov. 15, 1990

[30] Foreign Application Priority Data

Nov. 17, 1989 [DE] Fed. Rep. of Germany .... G8913603

[51] Int. Cl.[5] ..... B43K 29/00; B43K 24/06

[52] U.S. Cl. ..... 401/195; 401/109

[58] Field of Search ..... 401/195, 116, 109, 112

[56] References Cited

U.S. PATENT DOCUMENTS

| | | | |
|---|---|---|---|
| 3,597,100 | 8/1971 | Ganz | 401/116 X |
| 3,792,931 | 2/1974 | Ganz | 401/109 |
| 4,025,204 | 5/1977 | Hobbs | 401/109 |
| 4,606,665 | 8/1986 | Schleif et al. | 401/195 |
| 4,786,197 | 11/1988 | Koeln et al. | 401/109 X |
| 4,881,841 | 11/1989 | Irwin | 401/195 |
| 4,948,285 | 8/1990 | Schleif | 401/195 |

FOREIGN PATENT DOCUMENTS

| | | | |
|---|---|---|---|
| 1461291 | 3/1969 | Fed. Rep. of Germany . | |
| 2827542 | 1/1980 | Fed. Rep. of Germany | 401/195 |
| 8418819 | 6/1984 | Fed. Rep. of Germany . | |
| 8604475 | 2/1986 | Fed. Rep. of Germany . | |
| 8700113 | 1/1987 | Fed. Rep. of Germany . | |
| 656354A5 | 9/1982 | Switzerland . | |

*Primary Examiner*—Steven A. Bratlie

*Attorney, Agent, or Firm*—Eugene E. Renz, Jr.

[57] ABSTRACT

A writing instrument comprising an elongated hollow housing and a refill having a writing tip at one end. A cap member (50) mounted on the opposite open end of the housing can be rotated to selectively position the writing tip between a retracted storage position and an operative writing position. A feed sleeve (30) accepts the end of the refill (11) and engages in a carrier head sleeve (24) projecting into the open end of the housing. The carrier head (20) is supported on the housing in a rotatable but non-sliding manner and the feed sleeve (30) is supported interiorly of the housing in an axially displaceable and non-rotatable manner. A built-in stamp carrier is hinged to the carrier head so that it can be pivoted around an axis perpendicular to the longitudinal axis of the writing instrument between a position approximately parallel to the longitudinal axis and a position approximately perpendicular to the longitudinal axis. The carrier head (20) mounts an O-ring around its outer circumference. The cap (50) can be pushed over the O-ring in a friction-locking manner whereby torque is transmitted by rotation of said cap to position the writing tip between retracted and operative position.

9 Claims, 2 Drawing Sheets

HAND HELD WRITING INSTRUMENT WITH BUILT IN STAMP

FIELD OF THE INVENTION

The present invention relates to a hand held writing instrument having a built-in stamp carrier.

BACKGROUND OF THE INVENTION

Writing instruments of this general type are not new per se. These writing instruments typically comprise an elongated hollow tubular housing, a refill having a writing tip mounted in the housing and actuating means for positioning the refill selectively between a retracted, storage position interiorly of the housing and a writing position wherein the writing tip projects beyond the tip of the housing. West German Registered Utility Model Nos. 84-18, 819 and 86-04,475 are examples of prior art writing instruments which fit this general description. W. German Offlenlegungsschrift No. 1,461,291 shows a writing instrument with a mechanism for positioning a refill from a retracted, storage position to a writing position. These prior devices have certain disadvantages and drawbacks. For example, in these prior writing instruments, the holder or mechanism for the stamp takes up an inordinate amount of space and consequently very little room is left for the refill itself. Accordingly, only relatively small refills such as those shown in DIN 16,554 can be used in these writing instruments. Such small refills are used up and have to be replaced long before the ink for the stamp has run dry. Swiss Patent No. 656,354 and W. German Registered Utility Model No. 87-00,113 show other acceptable stamp designs which may be used with the present invention.

SUMMARY OF THE INVENTION

With the foregoing in mind, it is an object of the present invention to provide a writing instrument characterized by novel features of construction and arrangement capable of accommodating larger refills, particularly so-called "jumbo" refills, which the instrument can accommodate without a change in the external dimensions of the housing.

To this end, the present invention, in its broadest sense, utilizes a rotation mechanism as the feed mechanism which is actuatable by means of the cap of the stamp carrier. The stamp carrier has a part of the mechanism molded directly onto to it and is designed in such a way that the refill can be inserted directly into it. By this arrangement, a larger space is created in the axial direction of the writing instrument. This is necessary precisely in the case of hand held writing instruments wherein the stamp carrier with its stamp is located in the axial direction of the refill when in the non-operating position.

The feed mechanism is also characterized by novel features of construction and arrangement providing a mechanism which is relatively economical to manufacture and easy to assemble. The cap design of the present invention also has unique features facilitating reliable and advantageous actuation of the feed mechanism.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

Figure 2:
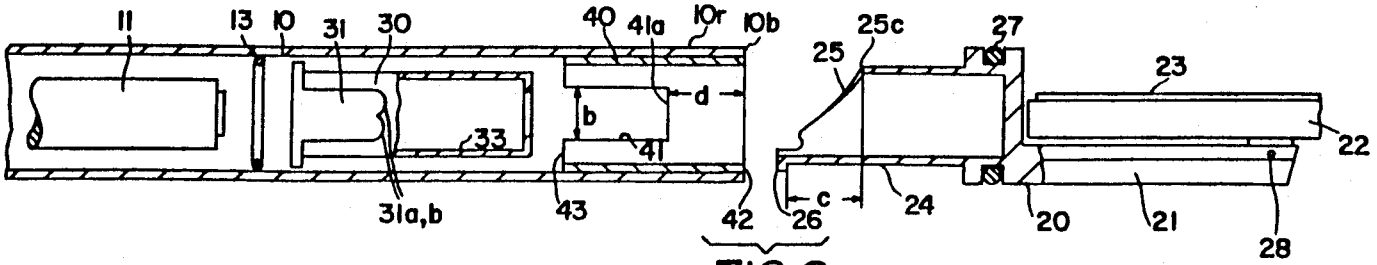
FIG. 2 is an exploded partial section showing some of the components of the writing instrument remote from the writing tip.
Figure 1:
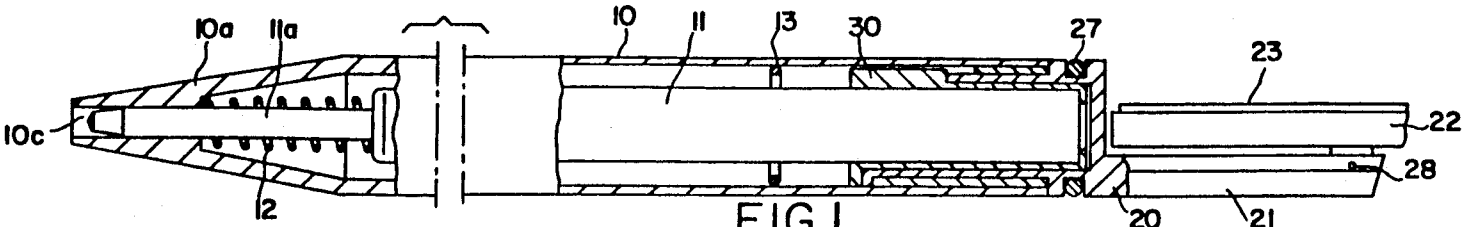
FIG. 1 is a transverse axial sectional view through a writing instrument made in accordance with the present invention.

Referring now to the drawings and particularly to FIGS. 1 and 2 thereof, there is shown a writing instrument constructed in accordance with the present invention comprising a generally elongated, two pieces tubular housing 10 which houses a so-called "jumbo" refill 11 which is free to slide axially in the housing 10. The refill 11 has a tip 11*a* at one axial end which is normally retained in a retracted storage position interiorly of the housing by a helical spring 12 and is extendable through an opening 10*c* in the writing tip end 10*a* of the housing against the action of the helical spring 12 to a writing position.

Figure 3:
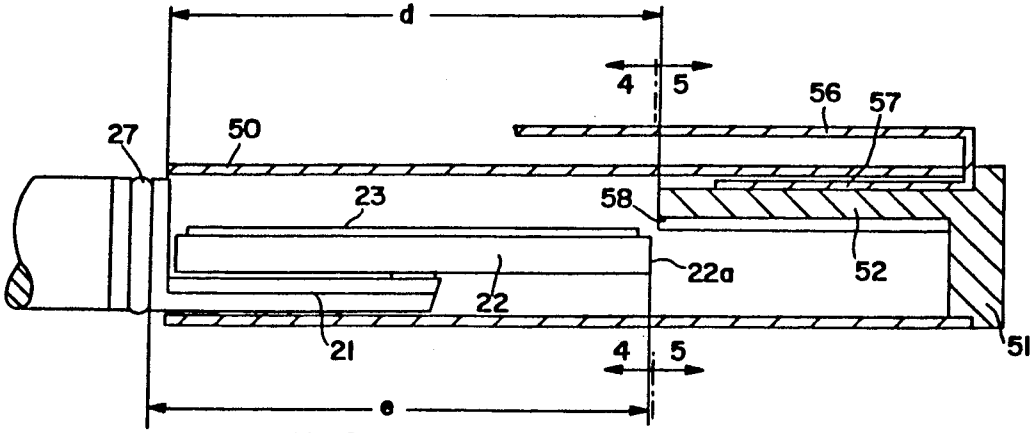
FIG. 3 is an enlarged fragmentary sectional view of the writing instrument taken in an axial direction with the cap in position.
Figure 5:
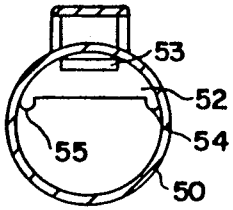
FIG. 5 is a transverse sectional view taken along lines 5—5 of FIG. 3.
Figure 4:
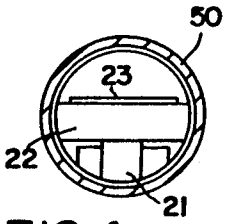
FIG. 4 is a transverse sectional view taken along lines 4—4 of FIG. 3.

A stamp 23 is mounted, preferably by means of an adhesive, at the rear of the writing instrument on the top side of a stamp carrier 22. The stamp carrier 22 is hinged by way of a pivot bearing 28 to an axially extending support shaft 21 of a stamp carrier head 20 which nests in the rear end 10*r* of tubular housing 10. In the storage position, the stamp assembly is located inside a cap 50 which is mounted on the rear end of housing tube 10 as best shown in FIGS. 3-5 inclusive. When utilizing the device for stamping purposes, cap 50 is removed and the writing instrument is moved from a horizontal position into a vertical position with the tip end 10*a*' facing upwardly. In this position, the stamp carrier 22 with stamp 23 flips into a horizontal position.

The writing instrument includes a feed mechanism which also comprises a rotation mechanism designed to position the refill 11 interchangeably between a storage position and a writing position. By means of the rotation mechanism, the refill 11 can be advanced by simply turning the stamp carrier head 20 or cap 50 whereby the refill is advanced from its storage position to the writing position. By reversing the rotation, the refill 11 is retracted back to its storage position by the action of the spring 12.

Considering the details of the feed mechanism, the mechanism comprises a carrier head sleeve 24 molded onto the carrier head 20. The free end of the sleeve 24 projects into the housing tube 10 and carriers a feed cam 25. A feed sleeve 30 is telescopically mounted in carrier head 24 in a manner to allow rotation therein. As best illustrated in FIG. 2, the refill 11 is inserted into the bore 33 of the feed sleeve 30. Feed sleeve 30 is free to slide axially inside housing tube 10 but is restrained from rotating relative thereto. To this end, a guide element 31 having convex followers 31*a*, 31*b* is provided which rests against the feed cam 25 in a sliding, non-positive manner. Accordingly, feed sleeve 30 is guided by means of guide element 31 which engages in a guide groove 41 of guide sleeve 40 which is press fitted in a rotation proof manner into the rear end 10*r* of housing tube 10. Carrier head sleeve 24 is pressed into guide sleeve 40 and in the assembled state is supported in a freely rotating manner by its collar section 26 against edge 43 of the axial end surface of guide sleeve 40.

Assembly of carrier head 20 into the housing tube 10 requires rotation to a position 90° away from that shown in FIG. 2 so that the collar section 26 can engage with guide groove 41 as it is pushed axially into the housing tube 10. To this end, the width "a" of collar 26 must be somewhat smaller than the width "b" of guide groove 41. (See FIGS. 2 and 8) In the final assembled state, carrier head sleeve 24 must be supported with freedom to rotate within the guide sleeve 40 but with as little play as possible. To facilitate assembly, the distance "c" between collar section 26 and catch 25*c* of feed cam 25 must be slightly greater than the distance "d" between the base 41*a* of guide groove 41 and end surface 10*b* of housing tube 10 facing away from the tip. By these dimensional relationships, when the carrier head sleeve 24 is introduced for assembly into the guide groove 41, collar section 26 engages in guide groove 41 before catch 25*c* arrives in the area of guide sleeve 40 or housing tube 10. Thus, it is impossible to feed this part any further without jamming.

The mechanism as a whole is retained in place and prevented from falling out by a snap ring 13 which is inserted into the housing tube 10 and operates to prevent feed sleeve 30 from falling out when refill 11 is replaced.

Figure 7:
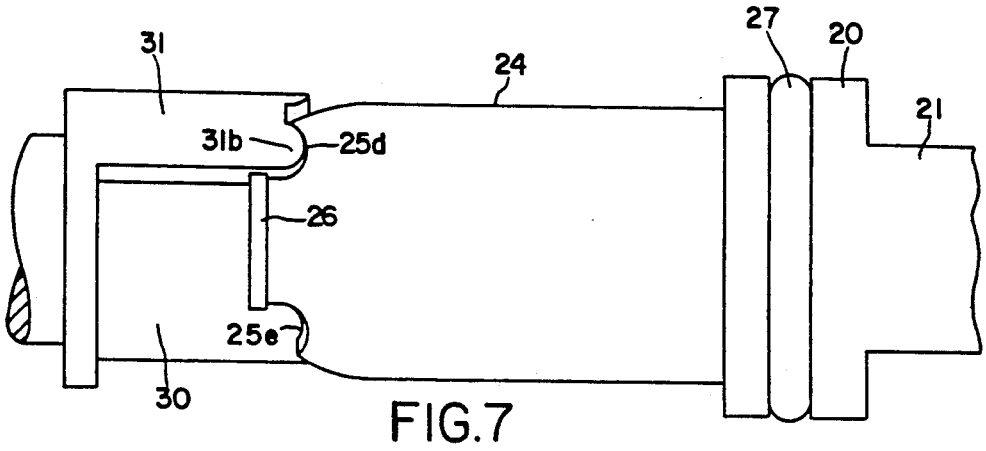
FIG. 7 is a view of the portion of the writing instrument shown in FIG. 6 as viewed from below.
Figure 8:
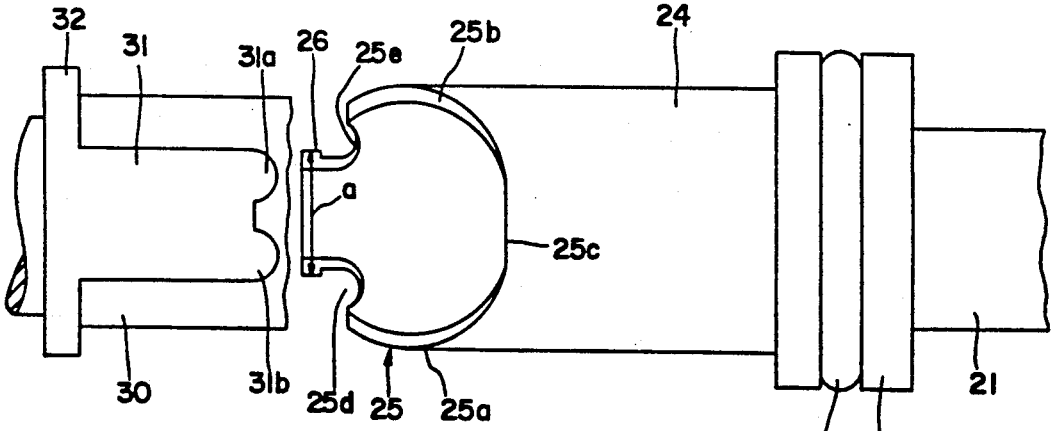
FIG. 8 is an exploded plan of the writing instrument shown in FIG. 6 as taken from above.

Considering now more specifically the design and function of the rotation mechanism which may be more easily understood with reference to the enlarged diagram views of FIGS. 7 and 8. As shown in FIG. 8, feed cam 25 comprises two cam sections, 25*a* and 25*b*, which rise from a central catch 25*c*. At the ends of the cam sections 25*a* and 25*b*, adjacent the tip, are catches 25*d* and 25*e*, respectively, and which corresponds to the writing position. Guide piece 31 with its adjacent convex followers 31*a* and 31*b* rests on feed cam 25. In the storage position, as shown in FIG. 6, followers 31*a* and 31*b* are located next to each other at catch 25*c*, whereas in the writing position, as shown in FIG. 7, either follower 31*a* engages in catch 25*e* or follower 31*b* engages in catch 25*d*.

The rotation mechanism can be actuated by means of carrier head 20. Cap 50 is actuatable to a position overlying carrier head 20, stamp carrier 22 and stamp 23 to avoid contact by the user with the ink stamp 23 and the consequent soiling of the user's hand. A torsionally rigid connection can be established between the cap 50 and the carrier head 20 to ensure satisfactory transmission of torque. To this end, cap 50 is designed in the form of a T so that it can be pushed into carrier head 20 only in a single position, namely that shown in FIGS. 3-5 inclusive. For this purpose, parallel ribs 54 and 55, which extend in the axial direction, are provided in the interior surface of cap 50 and are spaced a predetermined distance apart from one another. Accordingly, when the cap 50 has been set in position, the ribs 54 and 55 rests on the surface of stamp carrier 22 on both sides of stamp 23. To ensure easy and reliable manipulation of the ribs 54 and 55 into position, the distance "d" between the ribs 54 and 55 and the edge of the end surface of cap 50 is smaller than the distance "e" between stamp carrier end 22*a* and O-ring 27. (See FIG. 3) Thus, the O-ring 27 does not hinder insertion of the ribs 54 and 55 into position parallel to stamp 23 when the cap 50 is assembled.

Figure 6:
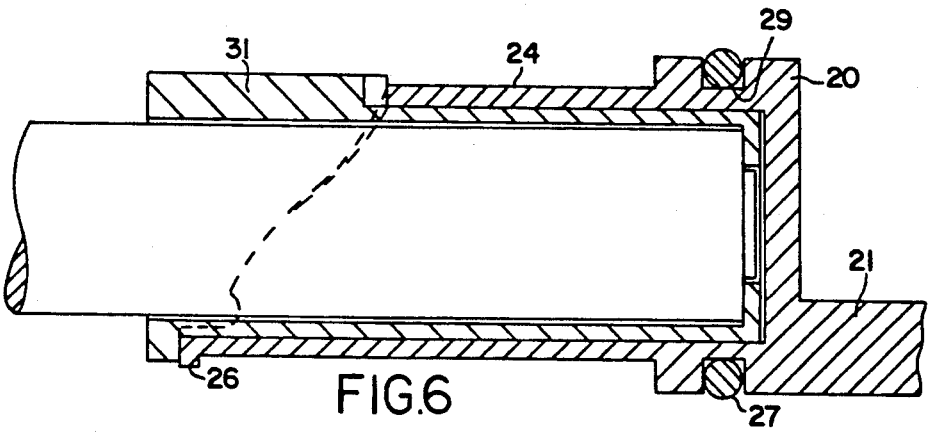
FIG. 6 is an enlarged axial cross sectional view of the feed mechanism located at the rear end of the writing instrument.

As shown in FIG. 6, the rubber O-ring 27 is inserted in a ring shaped groove 29 in the stamp carrier head 20 and functions to hold the installed cap 50 in the axial position. The O-ring 27 frictionally contacts the interior surface of the assemble cap 50. The cap as shown in FIG. 3 has not yet been pushed forward into the position which allows rotation of the carrier head 20.

An advantage of the cap designed as described above is that the interior space of the cap 50 does not come in contact with the ink stamp 23 in any position either when it is pushed on, or when it is rotated.

As shown in FIGS. 3 and 5, ribs 54 and 55 are preferably part of an insert 52 functioning as a clip support. Insert 52 has an elongated groove 53 to receive an end 57 of an externally mounted clip 56. This end 57 thus functions as a clip mount. In this position, the clip 56 is held in place by the pushed-in cap seal which has the so-called clip mount 52 mounted on the inner end thereof.

The writing instrument in accordance with the present invention is economical to manufacture and easy to assemble. The housing 10 consists of two pieces which are separably connected (not sown). Housing 10 is separated. The spring 12 is first inserted in the open end of the lower housing section followed by the refill 11. The housing 10 may then be reassembled. The snap ring 13 is positioned in place a predetermined distance down from the open end of the upper housing section and thereafter the sleeve 30 is inserted in this open end. The retaining sleeve 40 is now pressed fitted into the open end of the housing in the position shown in FIG. 2.

With the parts in this position, the spring 12 normally biases the refill 11 and retaining sleeve 30 rearwardly until the flange 32 of the sleeve 30 abuts the inner axial end face 43 of the sleeve 40. Thereafter, the carrier head sleeve 24 is assembled into the sleeve 40 with the collar 26 generally aligned with the slot 41. Even though the carrier head sleeve 24 is of a diameter slightly less than the internal diameter of the sleeve 40, the cam configuration permits easy insertion of the collar until it aligns and engages in the rear end of the slot 41. In this position, the carrier head sleeve 24 is simply pressed forwardly, until the cam surface 25 engages the follower surfaces 31 of the projecting guide element 31. The cap 50 is then fitted over the carrier in the manner shown in FIG. 3.

Upon use of the writing instrument, cap 50 is rotated such that a convex follower 31*a*, 31*b* rides along a cam section 25*a*, 25*b* of feed cam 25 which is at the forward part of carrier head sleeve 24. As a convex follower 31*a*, 31*b* rides upon cam section 25*a*, 25*b* the refill 11 is guided axially such that tip 11*a* emerges from opening 10*c* of the housing tube 10. Engagement of the guide 31 in slot 41 prevents rotation of the sleeve 30. Upon sufficient rotation, a convex follower 31*a*, 31*b* seats and is engaged in a catch 25*e*, 25*d* respectively so that the tip 11*a* is exposed through opening 10*c* to enable use of the refill 11 as a writing instrument. Normal writing pressure will not unseat a convex follower 31*a*, 31*b* from its respective seat 25*e*, 25*d*. When the stamp 23 is needed, cap 50 is slidably removed from the rear of the writing instrument. The writing instrument is positioned vertically such that tip 11*a* faces upward and the stamp assembly 22, 23 pivots about pivot bearing 28 and is supported by the support shaft 21 which in turn attached to the stamp carrier head 20. Stamp 23 is then ready for use. After use, the writing instrument is positioned horizontally such that the stamp assembly 22, 23 flips back into the non-use position and cap 50 is inserted back over the rear portion of the feed mechanism assembly. The refill 11*a* may be retracted back inside the housing tube 10 by rotating the assembled cap 50 in the direction such that the torque exerted upon the feed cam 25 overcomes the seating force of the convex follower 31*a*, 31*b* in its respective catch 25*e*, 25*d* and the convex follower 31*a*, 31*b* rides down the respective cam section 25*b*, 25*a* until the convex followers 31*a*, 31*b* rest in the catch 25*c*. At this position, refill tip 11*a* is fully within the housing tube tip end 10*a*.

Although a particular embodiment of the present invention has been illustrated and described herein, it is not intended to limit the invention and changes and modifications may be made therein within the scope of the following claims.

What is claimed is:

1. A writing instrument comprising an elongated hollow generally tubular housing, a refill in the housing having a writing tip at one end and a cap member (50) mounted on the opposite open end of the housing operable to selectively position the writing tip between a retracted storage position in the housing and an operative writing position, a feed sleeve (30) accepting the end of the refill (11) engageable in one end of a carrier head sleeve (24) projecting into the open end of the housing, means defining a feed cam (25) at said one end having catches (25*c*, 25*d*, 25*e*), said feed sleeve (30) having at least one follower (31*a*, 31*b*) which is normally biased to engage said feed cam (25) in a sliding and non-positive manner, means supporting said carrier head (20) by said carrier head sleeve (24) on the housing in a rotatable but non-sliding manner and means supporting the feed sleeve (30) interiorly of the housing in an axially displaceable and non-rotatable manner, a built-in stamp carrier (22) hinged to a carrier head (20) inserted in the tubular housing so that it can be pivoted around an axis perpendicular to the longitudinal axis of the writing instrument between a position approximately parallel to the longitudinal axis and a position approximately perpendicular to the longitudinal axis, said carrier head (20) having an O-ring (27) of rubber-elastic material mounted in a groove (29) in said carrier head, sleeve, said cap (50) engaging over said O-ring (27) in a friction-locking manner whereby torque is transmitted by rotation of said cap (50) to position the writing tip between retracted and operative position.

2. In a writing instrument according to claim 1, including a guide sleeve (40) having an axial guide groove (41) inserted in and permanently attached to the tubular housing (10); and wherein the feed sleeve (30) is supported by, and engages by means of a guide piece (31) in the guide groove (41) in an axially displaceable manner, the end of the guide piece (31) facing the feed cam (25) being furnished with said follower (31*a*, 31*b*) which rests on the cam.

3. A writing instrument according to claim 1, said feed cam (25) has two axially oriented, rising cam sections (25*a*, 25*b*) corresponding to the storage position of the writing refill (11) and a catch (25*d*, 25*e*) corresponding to the writing position at the end near the writing tip (10*a*).

4. A writing instrument according to claim 3, including a guide element (31) having two adjacent, convex followers (31*a*, 31*b*) engaging alternately in one of the two catches (25*e*, 25*d*) defining the writing position.

5. A writing instrument according to claim 1 wherein the feed sleeve (30) has a ring-shaped collar (32) projecting radially beyond the periphery of the feed sleeve (30) in an area facing the writing tip (10*a*) outside the feed cam (25), preferably between the two cam sections (25*a*, 25*b*) said collar (32) resting in a sliding manner on the end surface (43) of a guide sleeve (40) at the end facing the tip.

6. A writing instrument according to claim 1, wherein said carrier head sleeve (24) includes a collar section (26) and wherein the length (a) of the collar section (26) measured in the circumferential direction is slightly smaller than the width (b) of a guide groove (41) in the guide sleeve (40) and the axial distance (c) of the collar section (26) from the catch (25*c*) farthest away from the writing tip is greater than the axial distance (d) of the guide groove (41) from the edge (42) of the end surface of the guide sleeve (40).

7. A writing instrument according to claim 1 wherein an opening (33) in the feed sleeve (30) holding the end of the refill (11) has a cross section which matches that of the end of refill (11) at the end farthest away from the tip.

8. A writing instrument according to claim 1, characterized in that, two axially oriented stop ribs (54, 55) are provided inside the cap (50), which, when the cap has been put in place, rest on the top of the stamp carrier (22) on both sides of the ink-saturated stamp (23) of the carrier.

9. A writing instrument according to claim 8 characterized in that the axial distance (d) between the ends (58) of the ribs (54, 55) pointing toward the tip is smaller than the axial distance (e) between the end (22*a*) of the stamp carrier (22) facing the rear and rubber ring (27).

* * * * *